US006371611B1

(12) United States Patent
Billings et al.

(10) Patent No.: US 6,371,611 B1
(45) Date of Patent: Apr. 16, 2002

(54) MEDIA FEED UNIT FOR AN INK JET PRINTER

(75) Inventors: Aaron Wendell Billings, Versailles; David Vincent Iorio; John Dennis Zbrozek, both of Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/517,034

(22) Filed: Mar. 2, 2000

(51) Int. Cl.[7] ..... B41J 2/01

(52) U.S. Cl. ..... 347/104; 400/624; 400/625; 271/264

(58) Field of Search ..... 347/104; 400/624, 400/625, 642, 643, 644, 645; 271/10.11, 161, 225, 264

(56) References Cited

U.S. PATENT DOCUMENTS 4,881,835 A * 11/1989 Niikawa ..... 400/56
5,087,141 A 2/1992 Kelly
5,223,858 A 6/1993 Yokoi et al.
5,291,224 A 3/1994 Asano et al.
5,320,436 A * 6/1994 Hock et al. ..... 400/283
5,343,229 A 8/1994 Ohshima
5,515,094 A 5/1996 Tanaka et al.
5,738,454 A * 4/1998 Zepeda et al. ..... 400/625
5,805,176 A 9/1998 Saito et al.
5,857,671 A 1/1999 Kato et al.
6,007,063 A * 12/1999 Park ..... 271/273
6,009,302 A * 12/1999 Worley et al. ..... 400/624 X

* cited by examiner

*Primary Examiner*—John S. Hilten
*Assistant Examiner*—Minh H. Chau
(74) *Attorney, Agent, or Firm*—Jacqueline M. Despit; Ronald K. Aust

(57) ABSTRACT

A printer having a media path through which a media sheet having a first surface and a second surface is transported. The printer includes a printhead, and a media frame having a base and an extension portion angularly extending upwardly away from the base. The base has a first edge spaced apart from a second edge. The first and second edges are located for contacting the media sheet on the first surface. The extension portion has a support surface for providing support for the media sheet at the first surface. The printer further includes a roller assembly having a roller positioned opposed to the extension portion, the roller engaging the second surface of the media sheet to define a line of contact with the media sheet. The line of contact defined by the roller and the first edge of the base determine a first curvature of the media sheet having a first radius, and the first edge and the second edge determine a second curvature of the media sheet having a second radius.

19 Claims, 2 Drawing Sheets

MEDIA FEED UNIT FOR AN INK JET PRINTER

BACKGROUND OF THE INVENTION

1. Field of the Invention

The present invention relates to imaging devices, and more particularly, to a media feed unit for an ink jet printer.

2. Description of the Related Art

A paper path in a typical ink jet printer includes a paper pick mechanism which transports a media sheet past an ink jet printhead and delivers the media sheet to a sheet exit system.

Ink jet printers have used many types of paper picking mechanisms. For example, many ink jet printers use D-rollers with a spring loaded pressure plate or a spring loaded pressure plate that is pushed in and out of engagement with a fixed back-up roller at the top of the paper stack. Downstream of the paper picking mechanism, many such systems use corner bucklers to separate the top sheet of paper from the rest of the stack. Further downstream of that separator mechanism is usually a precision feed roll and spring loaded pressure rolls that work in conjunction with the feed roll to create accurate paper feed motions of the correct increment. As print quality requirements are continuously increased, the need for higher precision feed rolls and associated gear train is increased.

Downstream of the feed rolls is the exit system, which typically includes a driven segmented exit roll which engages the non-printed side of the media sheet, and multiple sets of back-up rollers, typically star wheels, positioned opposite the exit roll segments. The function of the exit roll is to feed the paper out of the printer once it has left the feed roll nip. Since the ink is still wet, the star wheels are designed to have a small contact point on the printed side of the media sheet so that ink on the printed side of the media sheet is not smeared or removed as the sheet exits the printer.

The low end of the ink jet printer market includes printers that print with large ink drops that do not require the precision of ink drop placement that the smaller drops do. In turn, for the low end printer, the incremental movement of the media sheet does not require as great of precision. To remain price competitive, these printers need to be as small and low cost as possible while still maintaining a reasonable print quality. However, the feed roll with associated pressure rolls and springs, the exit roll system including exit roll segments and associated star wheels and pressure springs, and the gear train to move these rolls precisely, drive up the cost of the printers.

Accordingly, what is needed in the art is a low end printer that can operate with acceptable incremental sheet movement without many of the media transport components that are typically found on low end printers.

SUMMARY OF THE INVENTION

The present invention is directed to a printer that can operate with acceptable incremental sheet movement without many of the media transport components that are typically found on low end printers.

One aspect of the invention is a printer having a media path through which a media sheet having a first surface and a second surface is transported. The printer includes a printhead having an ink jetting nozzle plate defining a print zone. The printer further includes a media frame having a base and an extension portion angularly extending upwardly away from the base. The base has a first edge spaced apart from a second edge. The first and second edges are located for contacting the media sheet on the first surface. The extension portion has a support surface for providing support for the media sheet at the first surface. The printer further includes a roller assembly having a roller positioned opposed to the extension portion, the roller engaging the second surface of the media sheet to define a line of contact with the media sheet. The line of contact defined by the roller and the first edge of the base determine a first curvature of the media sheet having a first radius, and the first edge of the base and the second edge of the base determine a second curvature of the media sheet having a second radius.

In another aspect of the invention, the media frame is configured such that the media path has a downward trajectory. The roller of the roller assembly is positioned opposed to an extension plate, wherein the roller engages the second surface of the media sheet to transport the media sheet in the media path.

An advantage of the present invention is that a smaller and lower cost printer is possible without sacrificing reasonable print quality.

Another advantage is that the present invention provides a simplified media transport system, which eliminates the need for a mechanically complicated media transport system including feed rolls with associated pressure rolls and springs, exit rolls with associated star wheels and star wheels springs, and the gear train to move these rolls.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
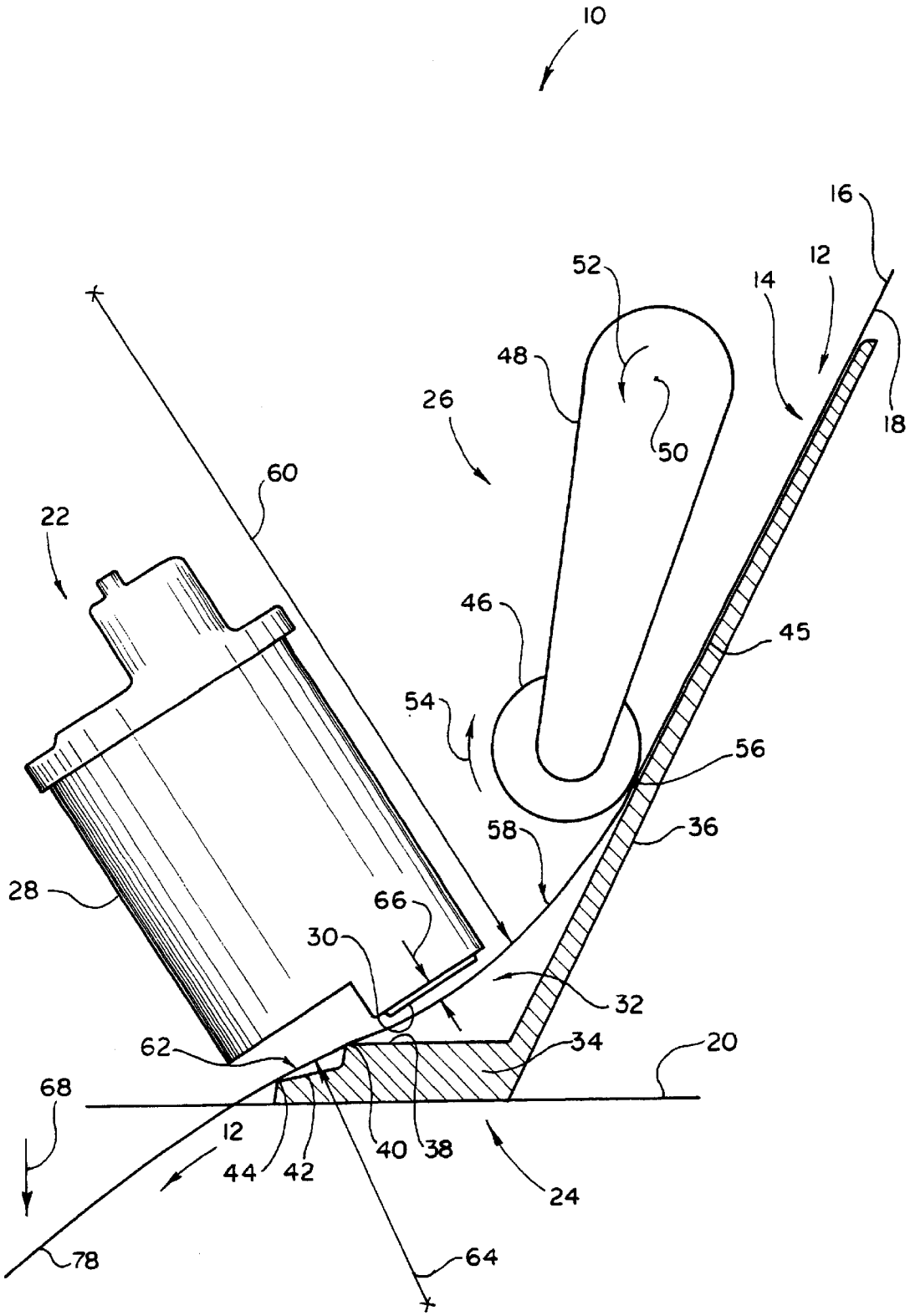
FIG. 1 is a side sectional view of a portion of a printer embodying the present invention.

Referring now to the drawings and particularly to FIG. 1, there is shown a printer 10 having a media path 12 through which a media sheet 14 is transported. Media sheet 14 has a print surface 16 on which ink is jetted, and an under surface 18. As shown in FIG. 1 in relation to a horizontal plane 20 of printer 10, media path 12 has a generally downward trajectory. Printer 10 includes a printhead 22, a media frame 24 and a roller assembly 26.

Printhead 22 includes an ink reservoir 28 that is in fluid communication with an ink jetting nozzle plate 30. Ink jetting nozzle plate 30 includes a plurality of individually controlled ink ejectors which eject ink on command in a manner well known in the art. The location and orientation of ink jetting nozzle plate 30 define a print zone 32.

Media frame 24 includes a base 34 and an extension portion 36 angularly extending upwardly away from base 34. Preferably, media frame 24 is a rigid unitary structure.

Upstream of print zone 32, media frame 24 defines a tray that can hold a plurality of media sheets (only media sheet 14 is shown). Downstream of print zone 32, media frame 24 provides guiding support for media sheet 14.

Base 34 includes a first ledge 38 defining a first edge 40, and a second ledge 42 defining a second edge 44. As shown, first edge 40 is spaced apart, i.e., offset, both vertically and horizontally from second edge 44. First and second edges 40,44 are located for contacting media sheet 14 on under surface 18 to provide support to media sheet 14 downstream of print zone 32.

Extension portion 36 is a plate having a surface 45 which provides support to the under surface 18 of media sheet 14 upstream of print zone 32. Due to the configuration of media frame 24, media path 12 has a generally downward trajectory in relation to horizontal plane 20 of printer 10, as shown. This downward trajectory allows media sheet 14 to exit the printer 10 with minimal momentum required, and without the need for an exit roll system.

Roller assembly 26 includes a roller 46 and a drive arm 48. Preferably, drive arm 48 includes at least one driven gear (not shown) to effect a torque on arm 48 about a pivot axle 50 in the direction depicted by arrow 52. The driven gear is driven by a motor and associated controller (not shown) to effect an incremental rotation of roller 46 in the direction depicted by arrow 54. As shown, roller 46 is positioned opposed to extension portion 36. Roller 46 engages surface 16 of media sheet 14 upstream of print zone 32 to pick media sheet 14, and then incrementally transports media sheet 14 through print zone 32. The point of engagement of roller 46 with media sheet 14 defines a line of contact 56 with media sheet 14.

Line of contact 56 (defined by roller 46) and first edge 40 of base 34 together determine a first curvature 58 of media sheet 14. As shown, first curvature 58 of media sheet 14 has a radius 60, and is concave with respect to printhead 22. The amount of curvature of first curvature 58 of media sheet 14 defines a gap 66 in print zone 32 between ink jetting nozzle plate 30 and print surface 16 of media sheet 14. Of course, radius 60 relates to the amount of curvature of curvature 58, and is relatively large in relation to the size of printer 10. For example, radius 60 may be in the range of 100 to 200 millimeters. However, in any event, gap 66 is established at an amount that is minimal while still avoiding the possibility of media sheet 14 contacting printhead 22.

In turn, first edge 40 of media frame 24 and second edge 44 of media frame 24 determine a second curvature 62 of media sheet 14 after the effects of gravity in the direction of arrow 68 pull the end 70 of media sheet 14 downward. As shown, second curvature 62 has a radius 64. Generally, radius 60 of first curvature 58 of media sheet 14 is larger than radius 64 of second curvature 62 of media sheet 14. Also, the direction of curvature of second curvature 62 is opposite that of first curvature 58.

Figure 2:
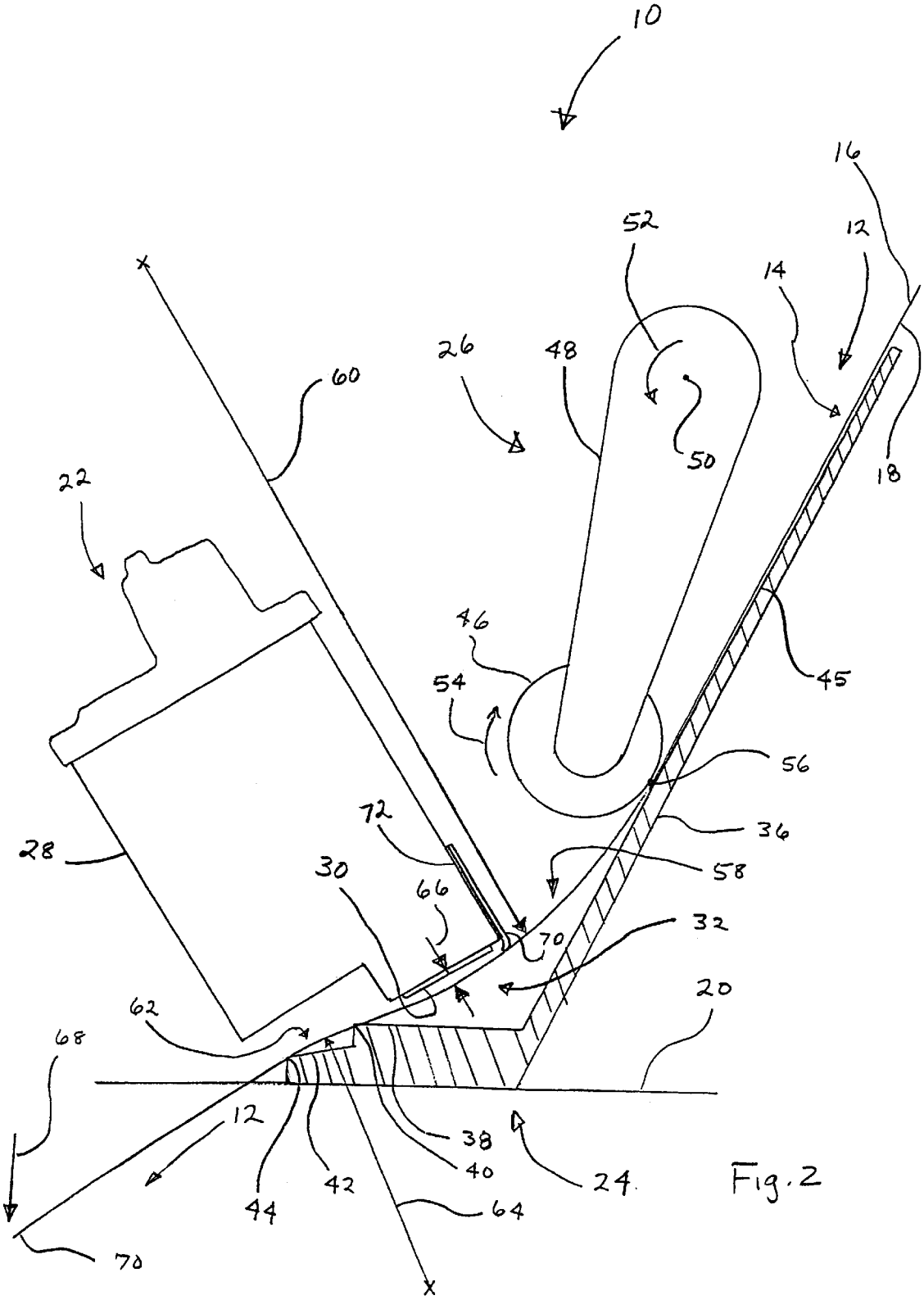
FIG. 2 is a schematic illustration of the printer of FIG. 1 modified to include a media sheet deflector.

FIG. 2 is substantially the same as FIG. 1, except for the addition of a sheet deflector 70. Sheet deflector 70 is attached to printhead 22 adjacent a leading side 72 of printhead 22. Sheet deflector 70 serves to define a fixed minimum value for gap 66, to thereby maintain a substantially constant gap between ink jetting nozzle plate 30 and print surface 16 of media sheet 14 in print zone 32.

In the embodiments of FIGS. 1 and 2, it can be seen that media sheet 14 is picked by roller 46 and transported by roller 46 in media path 12 through print zone 32 without the aid of a back-up roller or a spring loaded plate engaging under surface 18 of media sheet 14. Also, it can be seen that printhead 22 is oriented at an angle with respect to horizontal plane 20, which facilitates the placement of roller 46 of roller assembly 26 in closer proximity to print zone 32 than would otherwise have been the case. Once released by roller 46, media sheet 14 falls by the effects of gravity from printer 10 without the need of an exit roll system to transport media sheet 14 from printer 10.

Thus, the present invention provides a simplified media feed unit, particularly suited for a low end ink jet printer. In addition, the present invention eliminates the need for feed rolls with associated pressure rolls and springs, exit rolls with associated star wheels and star wheel springs, and the gear train to move these rolls.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which falls within the limits of the appended claims.

What is claimed is:

1. A printer having a media path through which a media sheet having a first surface and a second surface is transported, comprising:

a printhead having an ink jetting nozzle plate defining a print zone;

a media frame having a base and an extension portion angularly extending upwardly away from said base, said base having a first edge spaced apart from a second edge, the first and second edges being located for contacting said media sheet on said first surface, said extension portion having a support surface for providing support for said media sheet at said first surface; and a roller assembly having a roller positioned opposed to said extension portion, said roller engaging said second surface of said media sheet to define a line of contact with said media sheet, wherein said line of contact defined by said roller and said first edge of said base determine a first curvature of said media sheet having a first radius, and said first edge and said second edge determine a second curvature of said media sheet having a second radius.

2. The printer of claim 1, wherein said first curvature is concave with respect to said printhead.

3. The printer of claim 2, wherein an amount of said first curvature defines a gap between said ink jetting nozzle plate and said second surface of said media sheet.

4. The printer of claim 1, wherein said first curvature of said media sheet is located in said print zone.

5. The printer of claim 1, wherein said first radius is greater than said second radius.

6. The printer of claim 1, further comprising a deflector attached to said printhead to maintain a substantially constant gap between said ink jetting nozzle plate and said second surface of said media sheet.

7. The printer of claim 1, wherein said media frame is a rigid unitary structure.

8. The printer of claim 1, wherein said media frame is configured such that said media path has a downward trajectory.

9. The printer of claim 1, wherein said printhead is oriented at an angle with respect to a horizontal plane of said printer.

10. A printer having a print zone and a media path through which a media sheet having a first surface and a second surface is transported, comprising:

a media frame having a base and an extension plate angularly extending upwardly away from said base, said extension plate having a support surface for providing support for said media sheet at said first surface, said media frame being configured such that said media path has a downward trajectory; and a roller assembly having a roller positioned opposed to said extension plate, said roller engaging said second surface of said media sheet to transport said media sheet in said media path through said print zone.

11. The printer of claim 10, wherein said base includes a first edge offset from a second edge, the first and second edges being located for contacting said media sheet on said first surface.

12. The printer of claim 11, wherein said roller engages said second surface of said media sheet to define a line of contact, and wherein said line of contact defined by said roller and said first edge of said base determine a first curvature of said media sheet having a first radius, and said first edge and said second edge determine a second curvature of said media sheet having a second radius.

13. The printer of claim 12, further comprising a printhead having an ink jetting nozzle plate, and wherein said first curvature is concave with respect to said printhead.

14. The printer of claim 13, wherein an amount of said first curvature defines a gap between said ink jetting nozzle plate and said second surface of said media sheet.

15. The printer of claim 12, wherein said first curvature of said media sheet is located in said print zone.

16. The printer of claim 12, wherein said first radius is greater than said second radius.

17. The printer of claim 12, further comprising a printhead having an ink jetting nozzle plate that defines said print zone, and wherein said printhead is oriented at an angle with respect to a horizontal plane of said printer.

18. The printer of claim 10, wherein said base includes a first edge, said roller engaging said second surface of said media sheet to define a line of contact opposed to said extension plate, and wherein said line of contact defined by said roller and said first edge of said base determine a first curvature of said media sheet in said print zone.

19. The printer of claim 10, wherein said media frame defines a media tray.

* * * * *